US008246013B2

(12) United States Patent
Mauer et al.

(10) Patent No.: US 8,246,013 B2
(45) Date of Patent: Aug. 21, 2012

(54) CABLE GUARDRAIL SYSTEM AND HANGER

(75) Inventors: Frederick Mauer, Greenland, NH (US); Dallas James, Auckland (NZ); Steven J. Conway, Marion, OH (US)

(73) Assignee: Nucor Corporation, Charlotte, NC (US)

( * ) Notice: Subject to any disclaimer, the term of this patent is extended or adjusted under 35 U.S.C. 154(b) by 271 days.

(21) Appl. No.: 12/367,317

(22) Filed: Feb. 6, 2009

(65) Prior Publication Data

US 2009/0218554 A1 Sep. 3, 2009

Related U.S. Application Data

(60) Provisional application No. 61/027,314, filed on Feb. 8, 2008.

(51) Int. Cl.
*E04H 17/02* (2006.01)

(52) U.S. Cl. ..... 256/48

(58) Field of Classification Search ..... 256/23, 256/32, 47, 48, 52, 59, 65.03, 65.04, DIG. 3; 47/47, 46; 248/66
See application file for complete search history.

(56) References Cited

U.S. PATENT DOCUMENTS

| | | | | | |
|---|---|---|---|---|---|
| 2,204,559 | A | * | 6/1940 | Ahles | 256/13.1 |
| 3,161,263 | A | * | 12/1964 | Stokes | 248/218.4 |
| 4,249,635 | A | * | 2/1981 | West | 182/92 |
| 4,536,989 | A | * | 8/1985 | Caywood et al. | 47/46 |
| 4,550,891 | A | * | 11/1985 | Schaty | 248/68.1 |
| 4,642,940 | A | * | 2/1987 | Ettema et al. | 47/44 |
| 4,655,434 | A | | 4/1987 | Bronstad | |
| 4,708,323 | A | * | 11/1987 | Noakes | 256/35 |
| 4,784,515 | A | | 11/1988 | Krage | |
| 4,838,523 | A | | 6/1989 | Humble et al. | |
| 5,044,609 | A | | 9/1991 | Cicinnati | |
| 5,203,543 | A | | 4/1993 | Fleury | |
| 5,501,035 | A | * | 3/1996 | Downer et al. | 47/47 |
| 5,630,292 | A | * | 5/1997 | Heinz et al. | 47/46 |
| 5,655,270 | A | * | 8/1997 | Boisvert | 24/336 |

(Continued)

FOREIGN PATENT DOCUMENTS

JP 08134861 5/1996

(Continued)

OTHER PUBLICATIONS

Standard Specifications for Construction of Roads and Bridges on Federal Highway Projects; US Department of Transportation Federal Highway Administration; FP-96 1996; US Government Printing Office, Washington DC, US; 1996.

(Continued)

*Primary Examiner* — Michael P Ferguson
*Assistant Examiner* — Daniel Wiley
(74) *Attorney, Agent, or Firm* — Moore & Van Allen, PLLC; Jeffrey R. Gray

(57) ABSTRACT

A hanger for a cable guardrail system is disclosed including a first portion with first and second seats on opposite sides of a post each seat capable of supporting a cable, and a second portion capable of engaging the end of the post. Also disclosed is a cable guardrail system including a plurality of posts, a plurality of hangers attached to at least a portion of the plurality of posts, and at least two cables supported by the seats on opposite sides of the post. The cable guardrail system may redirect an impacting vehicle and dissipate a portion of the impacting vehicle's energy.

18 Claims, 11 Drawing Sheets

U.S. PATENT DOCUMENTS

| | | | | |
|---|---|---|---|---|
| 5,916,028 | A * | 6/1999 | Downer et al. | 47/46 |
| 5,967,497 | A | 10/1999 | Denman et al. | |
| 6,065,738 | A | 5/2000 | Pearce et al. | |
| 6,173,943 | B1 | 1/2001 | Welch | |
| 6,254,063 | B1 | 7/2001 | Rohde et al. | |
| 6,328,284 | B2 | 12/2001 | Wilding | |
| 6,398,192 | B1 | 6/2002 | Albritton | |
| 6,405,479 | B1 * | 6/2002 | Sherman | 47/46 |
| 6,434,883 | B1 * | 8/2002 | Martin | 47/46 |
| 6,488,268 | B1 | 12/2002 | Albritton | |
| 6,558,067 | B2 | 5/2003 | Ochoa | |
| 6,758,627 | B2 | 7/2004 | King | |
| 6,793,204 | B2 | 9/2004 | Albritton | |
| 6,863,264 | B2 | 3/2005 | Johansson | |
| 6,902,150 | B2 | 6/2005 | Alberson et al. | |
| 6,902,151 | B1 | 6/2005 | Nilsson | |
| 6,932,327 | B2 * | 8/2005 | Alberson et al. | 256/13.1 |
| 6,948,703 | B2 | 9/2005 | Alberson et al. | |
| 6,962,328 | B2 | 11/2005 | Bergendahl | |
| 6,971,638 | B2 * | 12/2005 | Burdick | 256/57 |
| 7,249,439 | B2 * | 7/2007 | Pierce, Jr. | 47/46 |
| 7,364,137 | B2 | 4/2008 | Neusch | |
| 7,398,960 | B2 | 7/2008 | Neusch | |
| 7,637,481 | B2 * | 12/2009 | Forero | 256/54 |
| 2005/0017231 | A1 * | 1/2005 | Sheelar | 256/47 |
| 2006/0027797 | A1 | 2/2006 | Sicking et al. | |
| 2006/0145131 | A1 | 7/2006 | Purvis | |
| 2006/0147261 | A1 | 7/2006 | Wong | |
| 2007/0102689 | A1 * | 5/2007 | Alberson et al. | 256/13.1 |

FOREIGN PATENT DOCUMENTS

| | | |
|---|---|---|
| JP | 2000-045233 | 2/2000 |
| KR | 200228230 | 4/2001 |
| KR | 200305609 | 2/2003 |
| KR | 20-0318128 | 6/2003 |
| KR | 10-0590898 | 6/2006 |
| KR | 20-0432896 | 12/2006 |

OTHER PUBLICATIONS

A Guide to Standardized Highway Barrier Hardware; AASHTO-AGC-ARTBA Joint Committee; Subcommittee on New Highway Materials; Task Force 13 Report; Secretary, AASHTO-ARTBA-AGC Task Force 13, Washington DC, US; 1995.

International Search Report in PCT/US2009/033442, dated May 25, 2009.

Written Opinion in PCT/US2009/033442, dated May 25, 2009.

* cited by examiner

CABLE GUARDRAIL SYSTEM AND HANGER

CROSS-REFERENCE AND RELATED APPLICATION

This application claims priority to U.S. provisional patent application Ser. No. 61/027,314, filed on Feb. 8, 2008, the disclosure of which is incorporated herein by reference.

BACKGROUND AND SUMMARY OF THE DISCLOSURE

The present invention is related to roadway barriers and safety systems, and more particularly, to cable guardrail systems.

Along many roadways it may be hazardous for a vehicle to leave the roadway. As a result, safety barriers, including guardrail systems, are used along roadways. The guardrail systems may act to contain and redirect an errant vehicle along such roadways. Such guardrail systems may dissipate some of the vehicle's energy. One such guardrail system is a cable guardrail system. Cable guardrail systems may reduce the damage caused to impacting vehicles and the injury to vehicle passengers. Compared with W-beam and three beam guardrail systems, cable guardrail systems are often more aesthetically appealing and may increase motorist sight distance. Cable guardrail systems also may reduce snow accumulation on adjacent highways and roadways.

A cable guardrail system in the past may have included a plurality of cables secured to a plurality of support posts. Various types of cables and wire ropes have been satisfactorily used for cable guardrail systems. Support posts have been made of wood, metal, or a combination of both. Additionally, cable guardrail systems have included cable anchors that fixed the end of the cables to the ground to maintain tension in the cables. Various types of anchor systems have been used including releasable anchors as described in U.S. Pat. No. 6,065,738 to Pearce.

The number of cables in prior cable guardrail systems has varied depending on factors such as the types of vehicles using the roadway and the types of hazards requiring the guardrail system. Cables have been attached to support posts using various attachment mechanisms. Some attachment mechanisms, such as hook-bolts, were used to attach a single cable to a support post. Another prior attachment mechanism attached three cables to one side of a support post as shown in U.S. Pat. Nos. 7,398,960 and 7,364,137 to Neusch. Other cable guardrail systems positioned cables on opposite sides of the support posts in order to protect against impact from either side such as might occur when the system was installed in a highway median.

The state of the art in cable guardrail systems has been documented and applied through specifications used by the industry. The United States Department of Transportation Federal Highway Administration provides "Standard Specifications for Construction of Roads and Bridges on Federal Highway Projects," including a section for cable guardrail systems and attachment mechanisms. Industry groups such as the American Association of State Highway and Transportation Officials (AASHTO), the Associated General Contractors (AGC) of America, and the American Road & Transportation Builders Association (ARTBA) have developed "A Guide to Standardized Highway Barrier Hardware" that included specifications for cable guardrails and posts. These specifications teach a cable guardrail system having a cable attached by hook-bolts and nuts to one side of a flanged-channel post. Additionally, agencies in both the United States and Europe have established guidelines for impact testing of safety barrier systems.

Prior cable guardrail systems had several drawbacks. Some cable attachments were difficult or costly to manufacture and install. Installation of cable guardrail systems exposes installation personnel to risks associated with working on or near active highways and roadways. Cable guardrail systems have been developed that reduce installation time thereby reducing the risk faced by installation personnel. There continues to be a need, however, for cable guardrail systems that reduce installation time and cost, and reduce risk to personnel.

A hanger for a cable guardrail system capable of supporting at least two cables traverse a post is presently disclosed to dissipate a portion of an impacting vehicle's energy and enable an impacting vehicle to be redirected by the system. The cable guardrail system may be installed adjacent a roadway, such as along median strips, roadway shoulders, or any other path that is likely to encounter vehicular traffic.

The disclosed hanger comprises a first portion having first and second seats each capable of supporting a cable, with the first and second seats on opposite sides of a post, and a second portion capable of engaging the end of the post.

Additionally, the disclosed cable guardrail system may comprise a plurality of posts capable of supporting at least two cables traverse the posts, a plurality of hangers attached to at least a portion of the plurality of posts, and at least two cables supported by the first and second seats on opposite sides of the posts.

BRIEF DESCRIPTION OF THE DRAWINGS

Presently contemplated embodiments of the present guardrail system are described below by reference to the following figures.

DETAILED DESCRIPTION OF THE DRAWINGS

Figure 1:
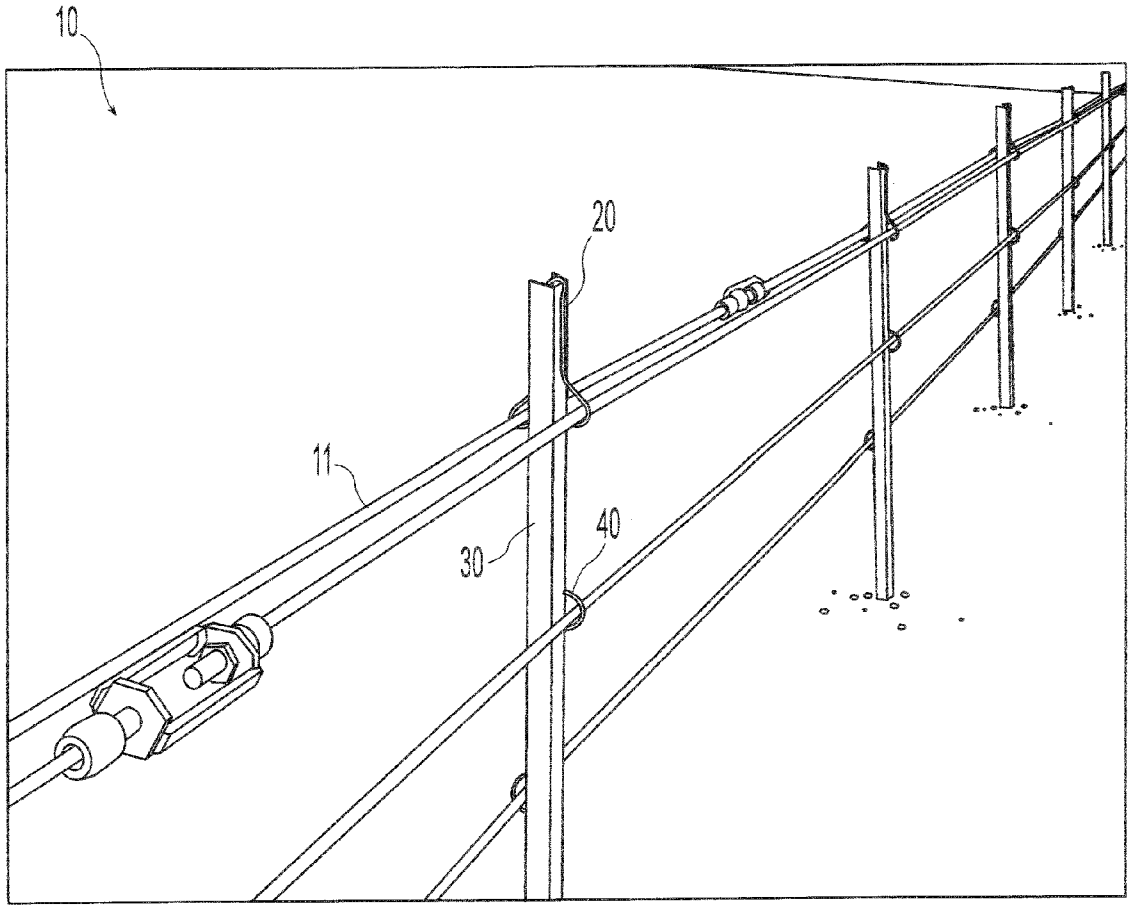
FIG. 1 is a side elevation view of a cable guardrail system.
Figure 2:
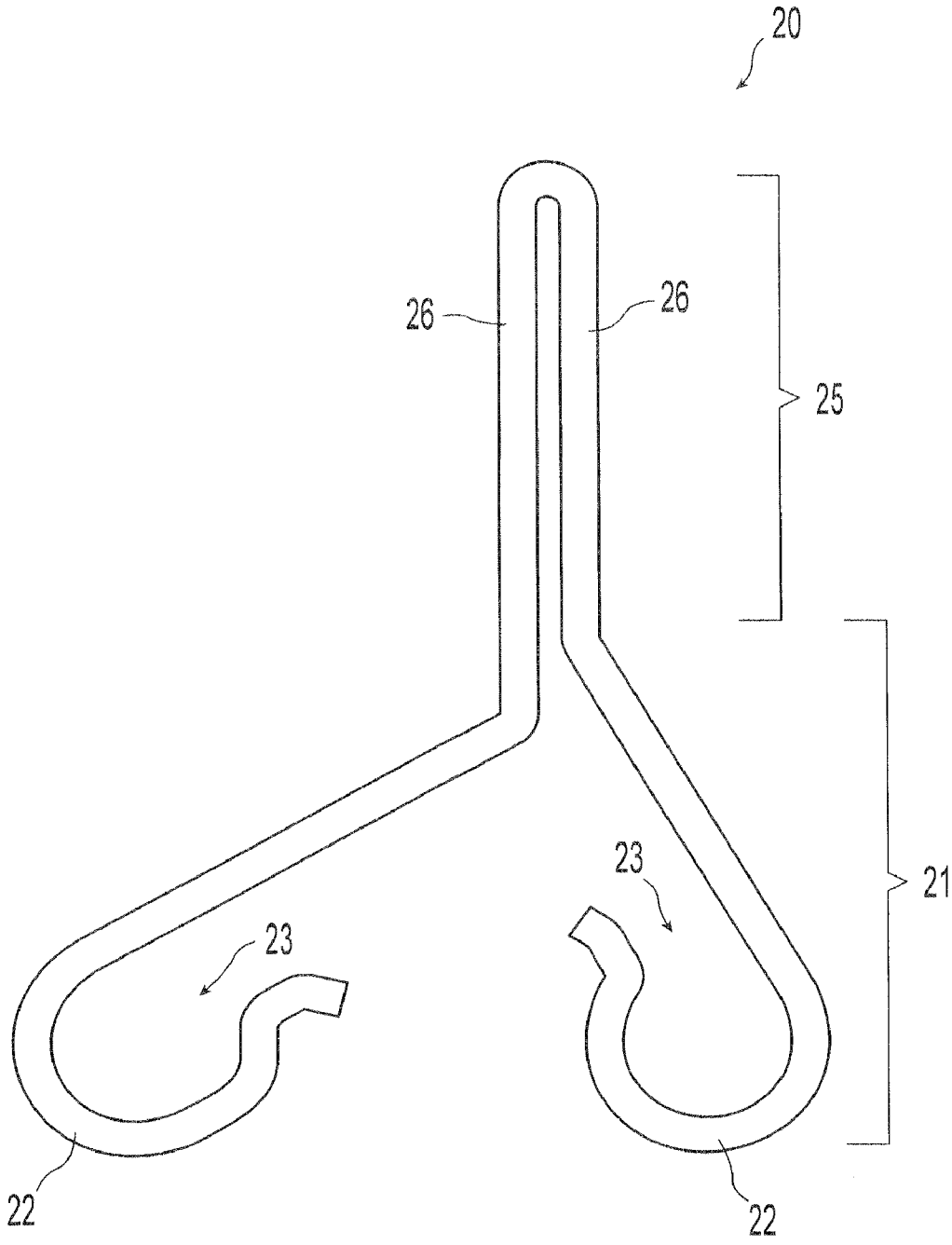
FIG. 2 is a side view of a hanger for a cable guardrail system.
Figure 3:
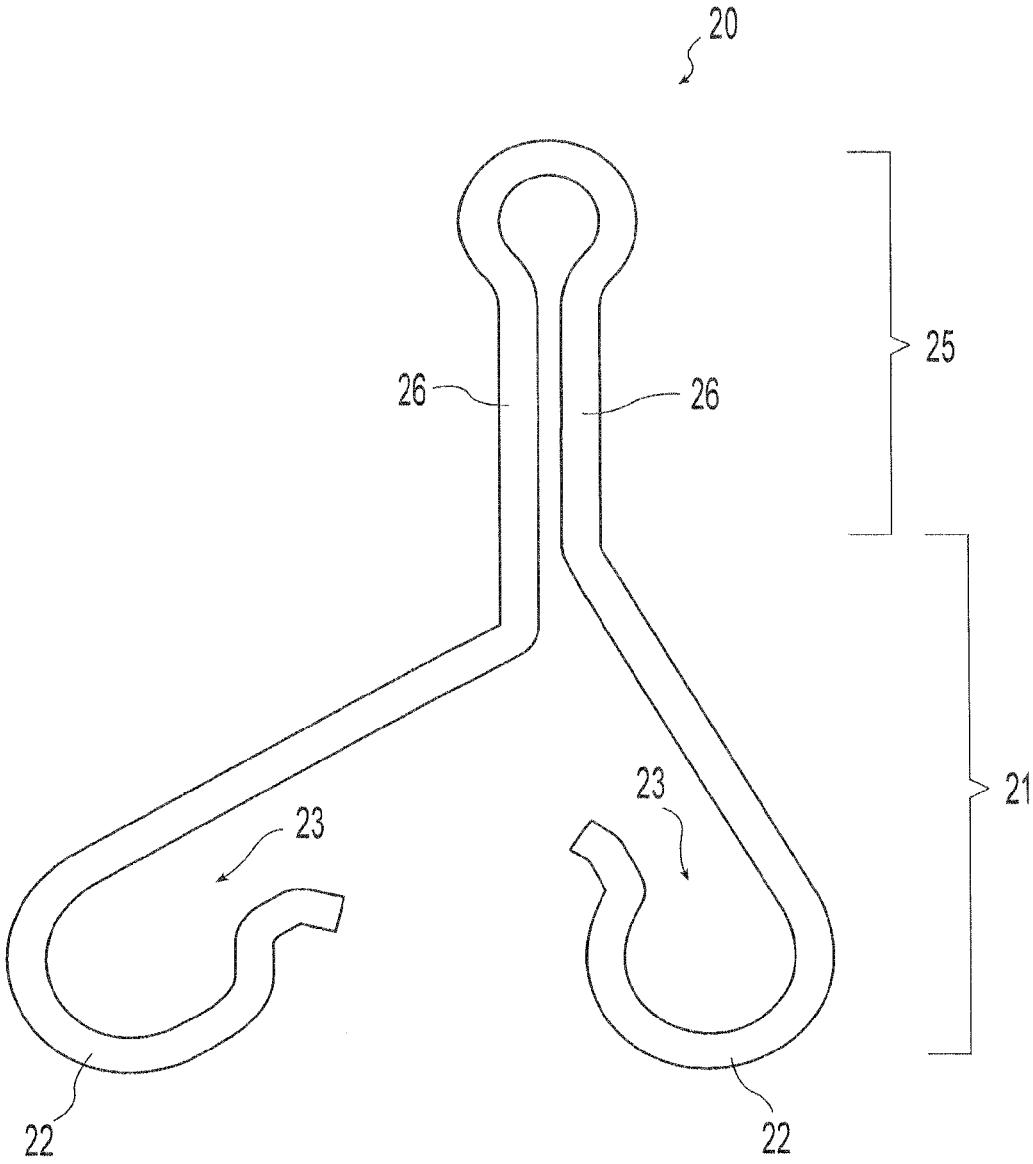
FIG. 3 is a side view of an alternative hanger.

Referring generally to FIGS. 1 through 15, a hanger 20 is disclosed for a cable guardrail system 10 operable to dissipate a portion of an impacting vehicle's energy and redirect the vehicle. The cable guardrail system 10 may be installed adjacent a roadway along median strips, roadway shoulders, or at other locations likely to encounter vehicular traffic. As shown in FIG. 1, the cable guardrail system 10 may comprise a plurality of posts 30, a plurality of hangers 20 attached to at least a portion of the plurality of posts 30, and at least two cables 11 on opposite sides of the posts. As shown in FIG. 2, each hanger 20 may have a first portion 21 having first and second retaining seats 22 each capable of supporting a cable. Each hanger may also have a second portion 25 capable of engaging the end 31 of the post.

When the cable guardrail system 10 is installed along the side of a roadway, the system is capable of dissipating a portion of an impacting vehicle's energy and redirecting the impacting vehicle along the general direction of the roadway. As the vehicle impacts the cable guardrail system 10, the cables 11 and support posts 30 may deflect from the installed position. The deflection of the cables 11 and the support posts 30 may dissipate a portion of the vehicle's impact energy. Additionally, forces from the vehicle impacting against the cables may cause the hanger 20 to move relative to the support post 30. As a result, the cables 11 may maintain contact with the impacting vehicle dampening yaw, pitch, and roll of the impacting vehicle.

Figure 10:
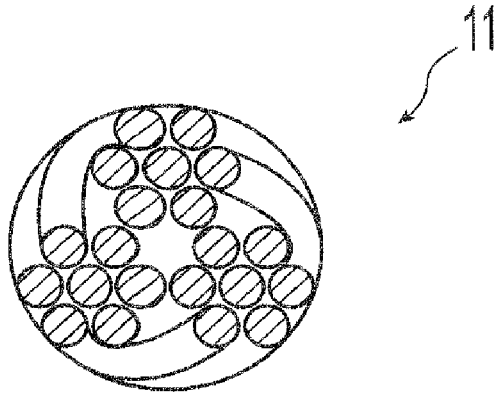
FIG. 10 is a cross-section view of a cable.

The cables 11 may be a 3×7 wire rope, as shown in FIG. 10. The wire rope may consist of three cords each consisting of seven strands wound together to form the cable. The diameter of each strand may be approximately three millimeters, and the diameter of the cable may be approximately nineteen millimeters. Alternately, other types of cable designs may be used. The cable 11 may also be pre-stressed.

The hanger 20 shown in FIG. 2 has the first portion 21 and the second portion 25. The first portion has first and second seats 22 each capable of supporting a cable adjacent a post 30. When installed on the post 30 the first and second seats are provided on opposite sides of the post 30 capable of engaging cables. As shown in FIG. 2, the seats 22 may be formed as a rounded loop. Alternatively, the seats 22 may be formed as hooks, rings, or other appropriate shapes capable of supporting a cable. The seats 22 may fully or partially encircle the cable 11. The seats 22 may also comprise features to secure the cable to the seat such as a latch, clasp, or similar mechanism. As shown in FIG. 2, the first portion may include a lead-in 23 having a shape for receiving the cable 11. The lead-in 23 may include a friction area 24 providing resistance to the cable 11 backing out of the seat 22.

The seats 22 may be formed in multiple ways. The seats 22 may be formed as an integral part of the first portion 21. Alternatively, the seats 22 may be formed as separate pieces and attached to the first portion 21, such as, but not limited to, by welding, crimping, fastening, interlocking, or another suitable attachment technique.

Figure 5:
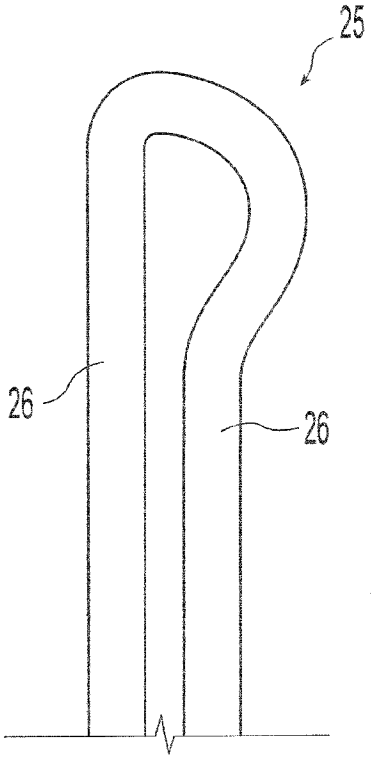
FIG. 5 is a side view of a second portion of a second alternative hanger.
Figure 4:
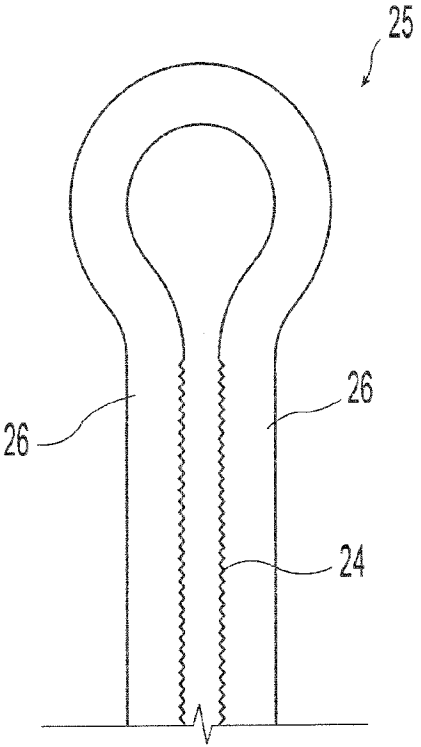
FIG. 4 is a side view of a second portion of an alternative hanger.

The second portion 25 of the hanger is capable of engaging the end of the post 30. The second portion 25 may be generally U-shaped as shown in FIG. 2, so that the second portion 25 may slideably engage the end of the post 30 in a top-down installation. The U-shaped second portion 25 may have opposing sides or legs 26, connected by an arcuate connecting portion. Other forms of the second portion 25 are also contemplated. For example, the second portion 25 may have straight or tapered sides 26 that are substantially parallel or angular. The sides 26 may taper toward each other such that the sides provide a clamping force on the end of the post. In another example, the second portion 25 may be shaped such that one side is substantially straight while the other side is bent, curved, or angular such as shown in FIG. 5. Various configurations of the second portion 25 are contemplated to adapt to various post configurations such as U-channel, I-beam, box, and other post geometries. Additionally, the length of the sides 26 may be selected to position the cables at the proper height relative to the top of the post 30. The second portion 25 may include friction enhancing surface characteristics in at least a portion of the area contacting the post 30 such as shown in FIG. 4. Such surface characteristics may also enhance the system's ability to dissipate energy and redirect an impacting vehicle. The friction enhancing surface characteristics may include virtually all types of surface patterns, such as but not limited to a grit blast texture, scored surface, serrated surface, grit-carrying coating, or other friction enhancing surface or coating.

The first portion 21 and the second portion 25 may be formed together out of one piece of material, such as shown in FIG. 2. Alternately, the first portion 21 and the second portion 25 may be separate pieces joined together, such as, but not limited to, by welding, crimping, fastening, interlocking, or other techniques. As separate pieces, the first portion 21 and second portion 25 may be of different materials as desired.

The hanger 20 may be formed from steel, in the form of sheet, bar stock, tube stock, or wire stock. Alternatively, the hanger 20 may be formed from other metal or non-metal materials of suitable strength. The hanger may be formed from steel of spring and/or other suitable specifications. Additionally, the hanger 20 may have a coating to provide durability and protection against rusting in addition to engagement enhancement. The hanger 20 may be hot-dip coated with zinc, aluminum, zinc-aluminum alloy or other coating to provide protection against the elements. Alternately, the hanger 20 may be coated with a polymer or other paint coating for a protection against the environment.

Figure 6:
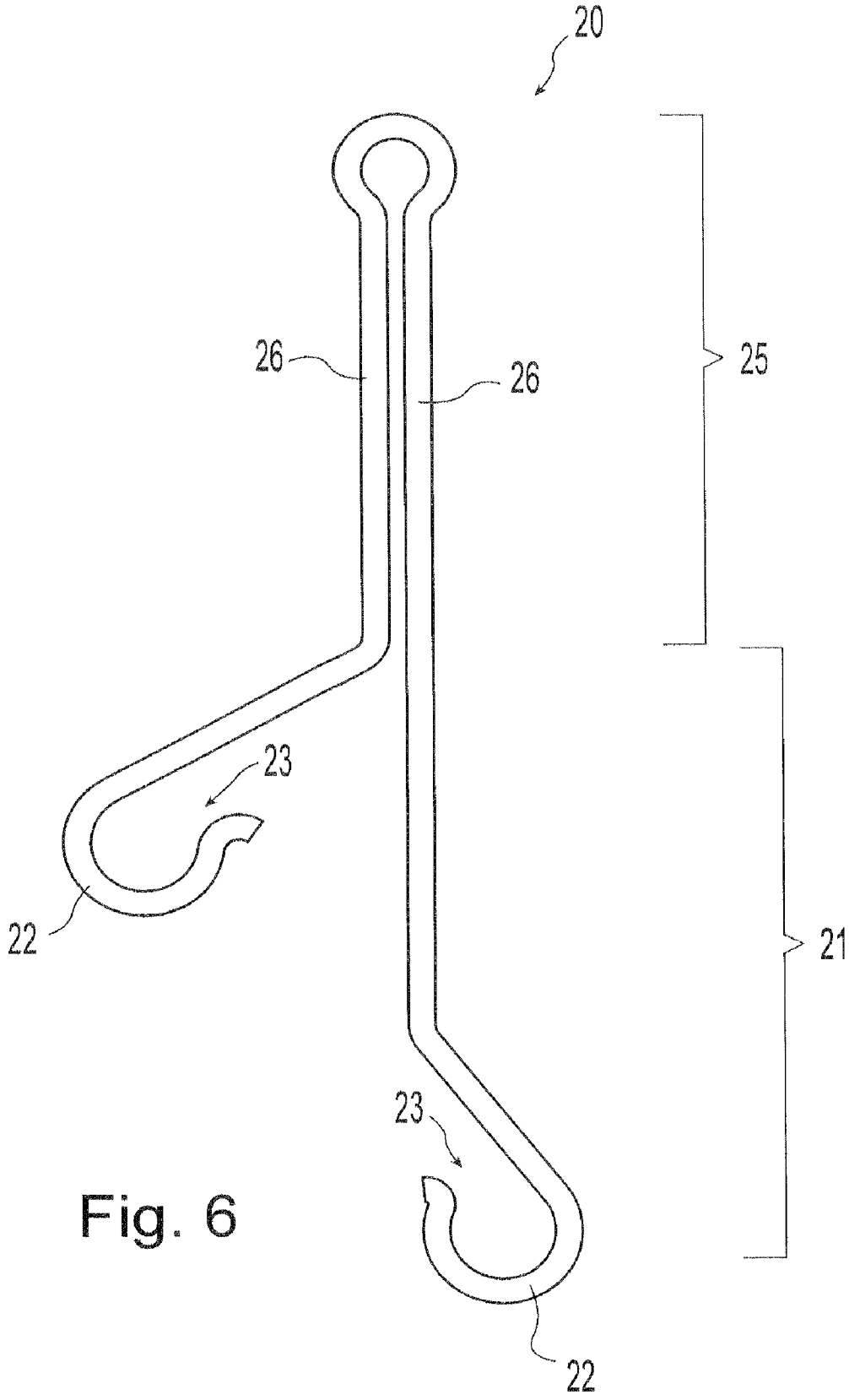
FIG. 6 is a side view of a third alternative hanger.
Figure 7:
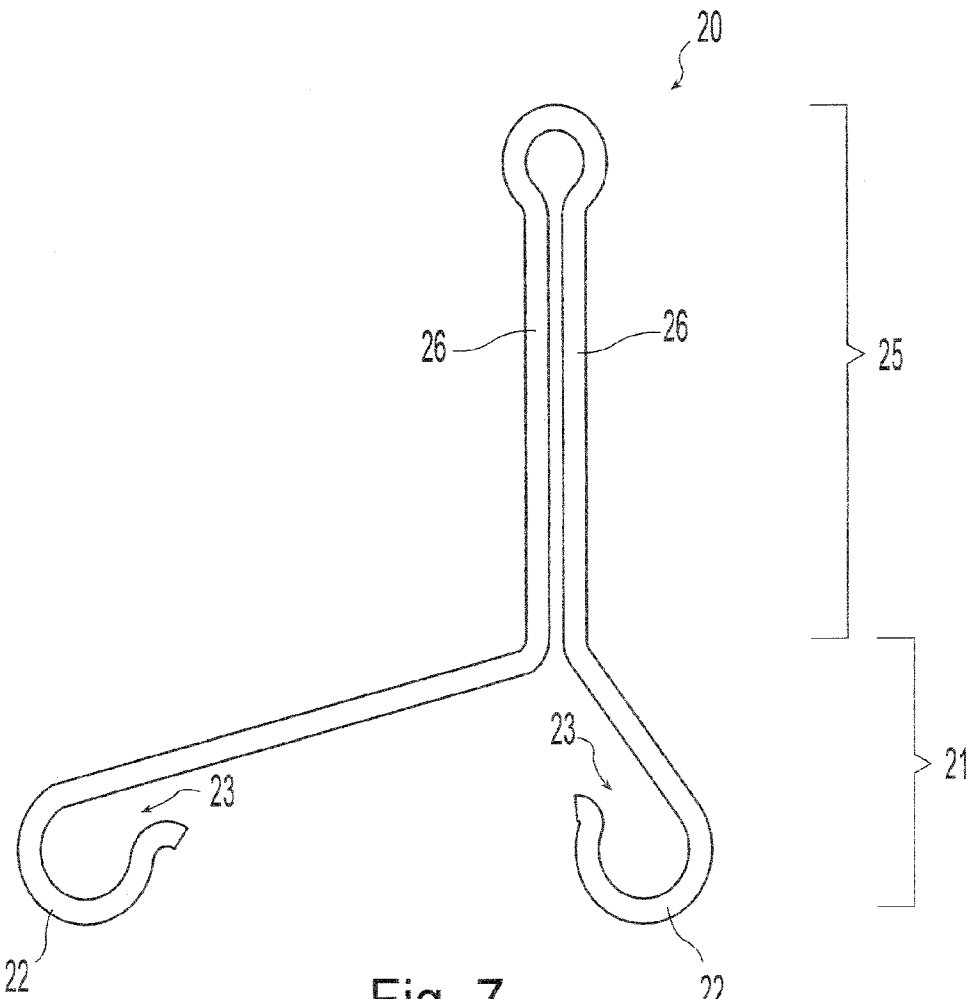
FIG. 7 is a side view of a fourth alternative hanger.

Other hanger configurations are also contemplated. As shown in FIG. 6, the seats 22 may be positioned such that the first seat is closer to the end of the post 30 than the second seat. In this configuration, the sides 26 of the second portion 25 may be of different lengths. This configuration may allow the cables to be positioned at different heights relative to the ground. Alternatively, if the cable guardrail system 10 is installed on sloped ground the hanger of FIG. 6 may permit the cables 11 on opposite sides of the post 30 to remain at approximately the same height relative to the ground. Another hanger is shown in FIG. 7 in which the first seat is laterally offset from the post 30. This configuration may be useful to provide greater separation between the post and the cables.

Figure 9:
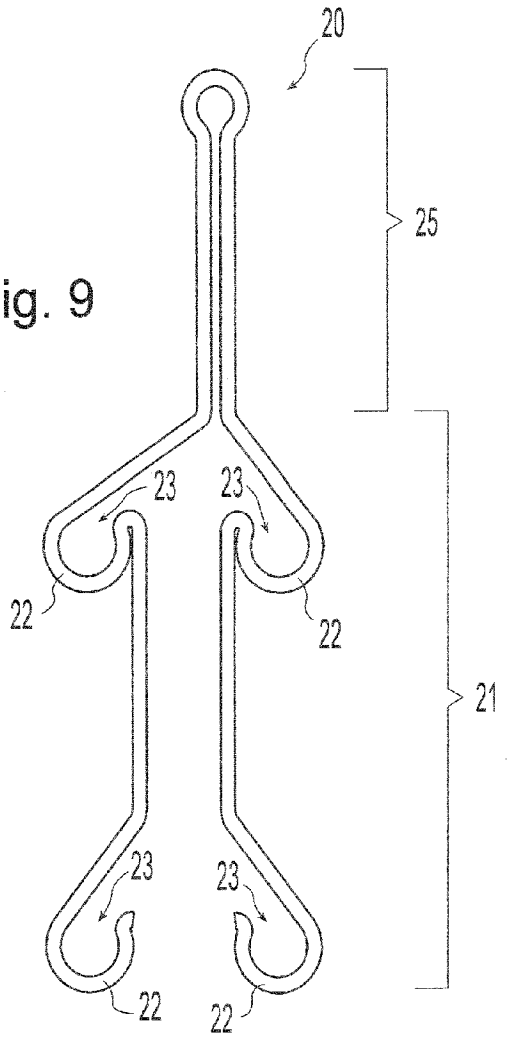
FIG. 9. is a side view of a sixth alternative hanger.
Figure 8:
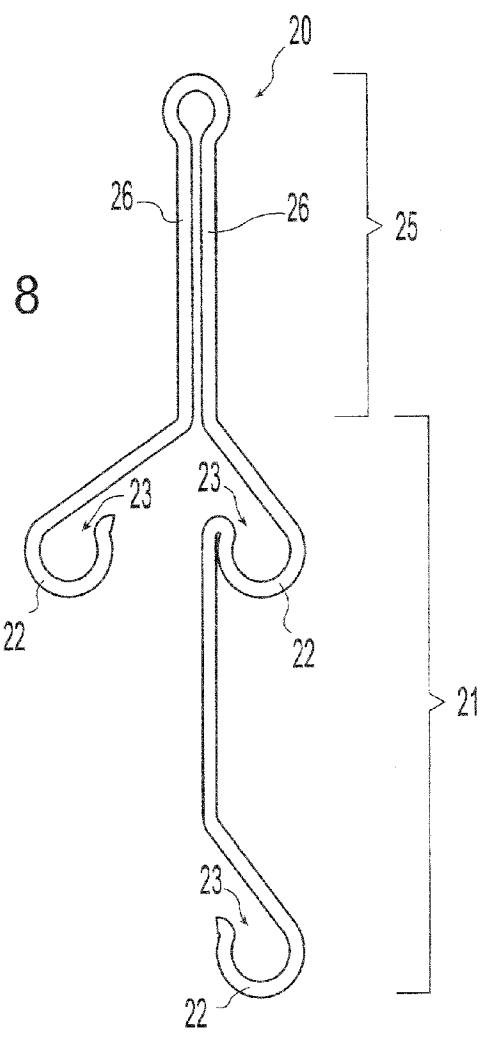
FIG. 8 is a side view of a fifth alternative hanger.

A further alternative hanger is depicted in FIG. 8 which shows a hanger 20 with a third seat in addition to the first and second seats. This configuration permits one cable 11 to be supported on one side of the post 30, while two cables 11 are supported on the opposite side of the post. This hanger 20 may be useful when the cable guardrail system 10 is installed between hazards of different size or height, or when greater protection is required on one side of the guardrail system. Additionally, this configuration may permit cables to be placed at an appropriate height relative to the ground when the guardrail system is installed on sloped ground. A further alternative hanger is depicted in FIG. 9 which shows a hanger 20 with a fourth seat on positioned on the opposite side of the post from the third seat. Combinations and alterations of the above hanger configurations are also contemplated that may allow a hanger 20 to be adapted to various posts and installation environments.

During installation or maintenance of a cable guardrail system 10, the second portion 25 of the hanger 20 may slideably engage the end of the post 30 in a top-down installation. A first cable and a second cable may then be attached to the hanger 20 on opposite sides of the post. Such an installation may be faster and more efficient than installation of prior cable attachment mechanisms. Faster installations are less costly and reduce the time that installation personnel are exposed to the hazards associated with working alongside roadways. Further, maintenance of a cable guardrail system 10 may be improved because the hanger 20 may be removed and reattached.

Alternatively, a hanger 20 may be attached to a first cable and a second cable, then attached to a post 30. The second portion 25 of the hanger 20 may then slideably engage the end of the post 30 in a top-down installation. By first attaching the hanger to the cables, the cables may assist in installing the hanger 20 over the end of the post.

Figure 14A:
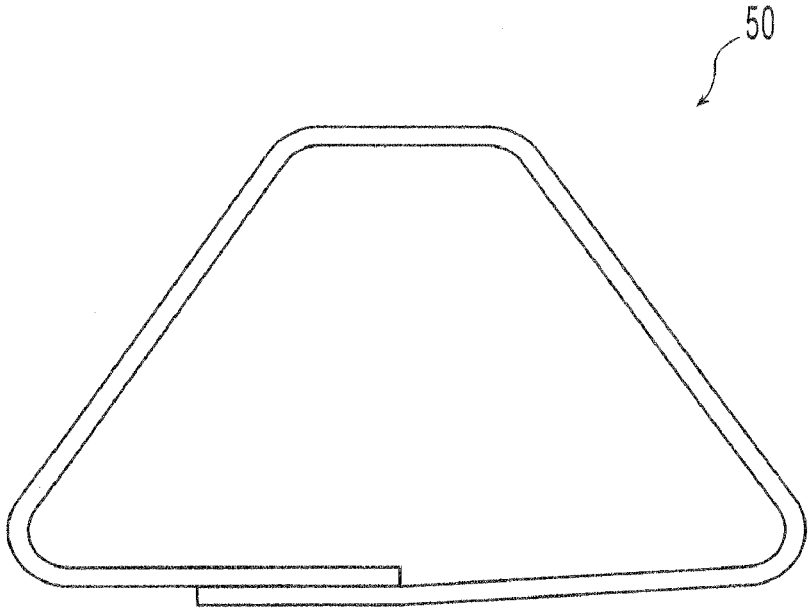
FIG. 14 is a side view of a clip.
Figure 14B:
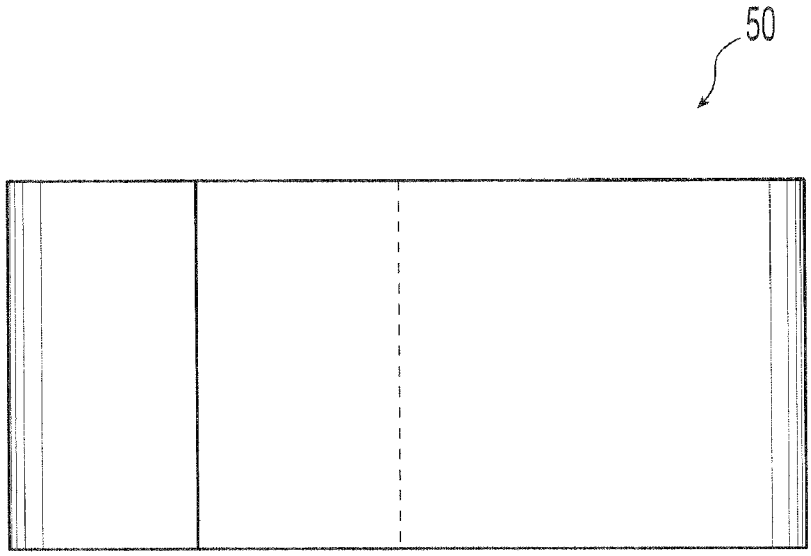
Figure 15:
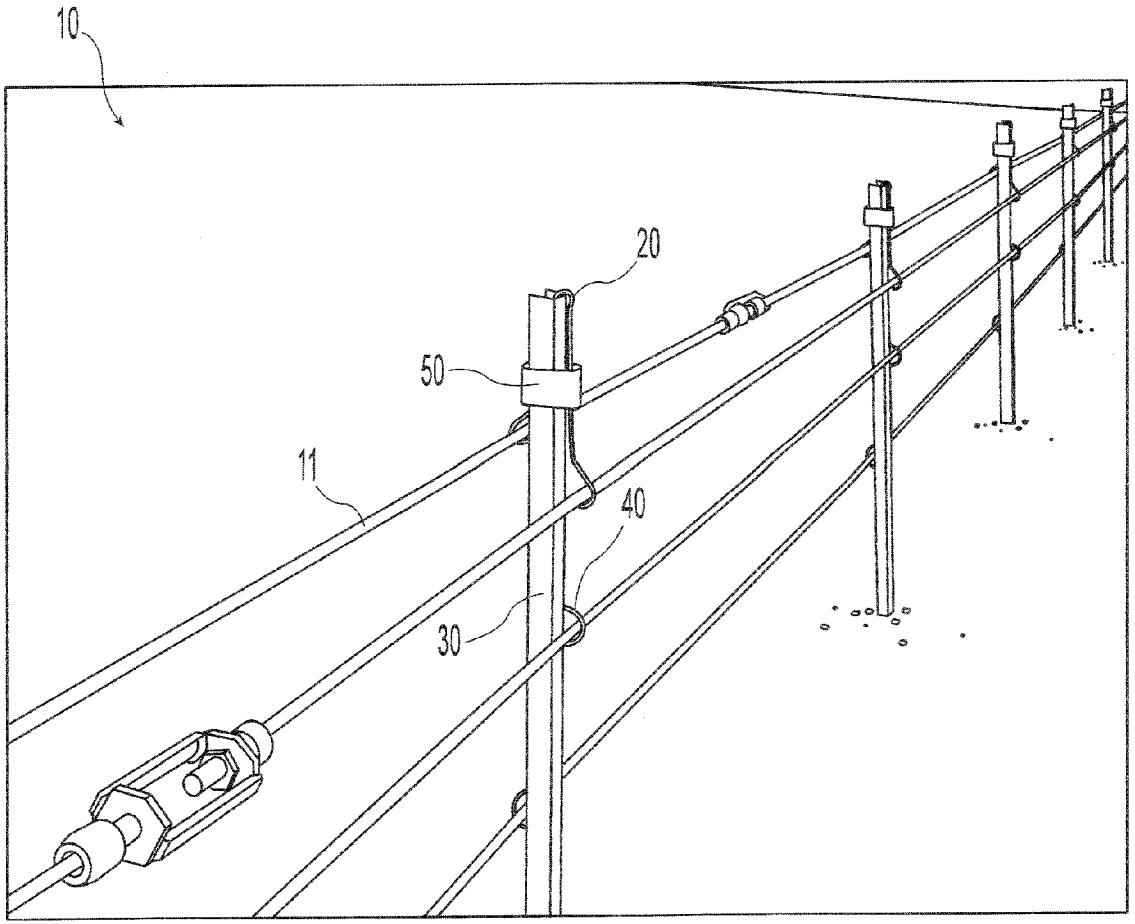
FIG. 15 is a side elevation view of an alternative cable guardrail system.

As shown in FIGS. 14 and 15, a clip 50 may be slideably attached to the post 30. The clip 50 may assist in securing the hanger 20 to the post 30 during installation. The clip 50 may also assist in preventing the hanger 20 from separating from the post 30 after installation, during maintenance, or during a vehicle impact.

The clip 50 may be formed from steel, in the form of sheet, bar stock, tube stock, or wire stock. Alternatively, the clip 50 may be formed from other metal or non-metal materials of suitable strength. The clip may be formed from steel of spring and/or other suitable specifications. Additionally, the clip 50 may have a coating to provide durability and protection against rusting and other environment conditions. The clip 50 may be hot-dip coated with zinc, aluminum, zinc-aluminum alloy or other coating to provide protection against the elements. Alternately, the clip 50 may be coated with a polymer or other paint coating.

As shown in FIG. 15, the clip 50 may be installed over the end of the post 30 after the hanger 20 has been installed. The clip 50 may contact the one side 26 of the second portion 25 of the hanger 20. The clip 50 may also contact the other side 26 of the second portion 25, or alternatively, the clip may also contact the post 30. In one example, the clip 50 may contact both the dextral flange 33 and sinistral flange 34 of a U-channel post.

Figure 11:
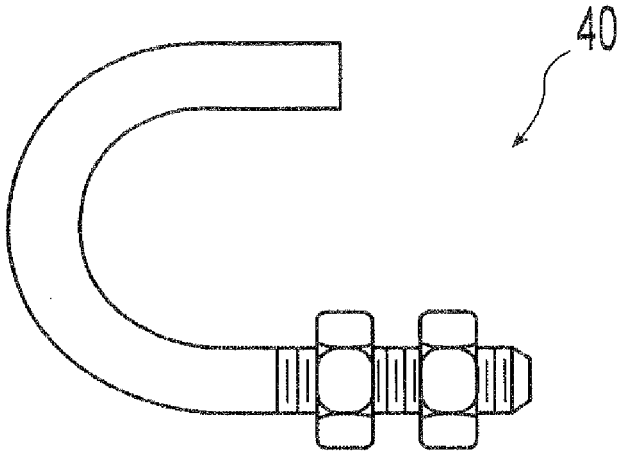
FIG. 11 is a side view of a hook-bolt cable attachment.

The cable guardrail system 10, as shown in FIG. 1, is operable to dissipate a portion of the energy of an impacting vehicle and redirect the vehicle along the direction of the roadway. A cable guardrail system 10 may comprise a plurality of posts 30, a plurality of hangers 20 attached to at least a portion of the plurality of posts 30, and at least two cables 11 positioned on opposite sides of the posts. Additionally, a cable guardrail system 10 may comprise more than two cables 11. Additional cables 11 may be supported by seats in a hanger 20 such as that illustrated in FIG. 8. Alternatively, additionally cables 1 may be supported by another cable attachment mechanism such as a hook-bolt 40 as shown in FIGS. 1 and 11. One embodiment may include a first hook-bolt capable of supporting a middle cable and a second hook-bolt capable of supporting a lower cable, and alternative embodiments may include some posts where all cables are supported by hook-bolts or other attachment mechanisms. The middle and lower cables may be on the same side or on opposite sides of the post 30 depending upon the hazards requiring installation of the cable guardrail system 10.

When an errant vehicle impacts the cable guardrail system 10, the post 30 and cables 11 at the point of impact may deflect from the installed position. As the defection increases, the hanger 20 may release from the post 30 so that the cables 11 may remain in substantial contact with the errant vehicle. Friction enhancing surfaces on the second portion 25 of the hanger 20 or on the post 30 may increase the energy dissipated as the hanger 20 separates from the post 30. As the cables 11 release from the posts 30, the overall deflection may increase. The spacing of posts 30 and cable anchors (not shown) may be adjusted to maintain the desired deflection of the cable guardrail system 10 during a vehicle impact.

Figures 12, 13:
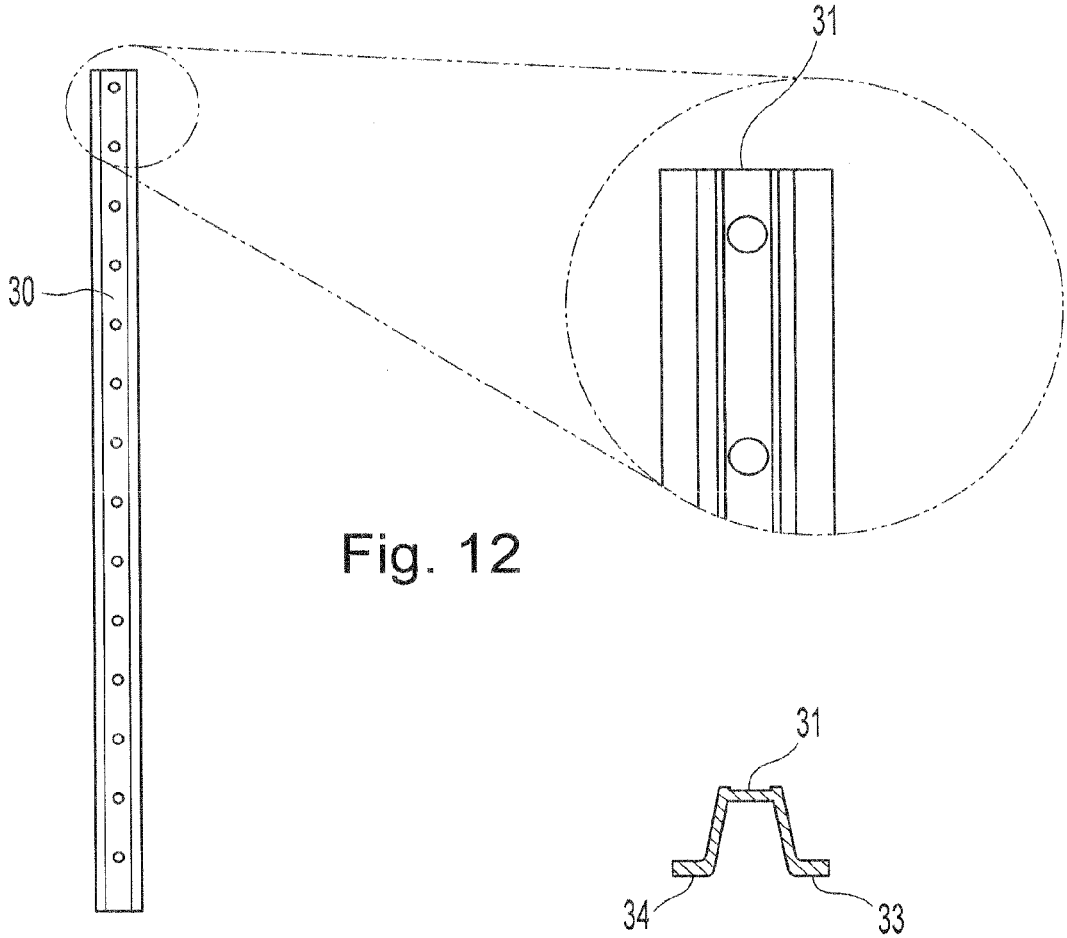
FIG. 12 is a side view of a post.
FIG. 13 is a cross-section view of a post.

As shown in FIG. 12, the post 30 may be generally defined as a U-channel post having a central web 32 and formed with a dextral flange 33 and a sinistral flange 34 such that the post 30 has a flanged, generally U-shaped cross-section. The post 30 may be of a design similar to the U-channel metal posts currently offered by Nucor Marion Steel under the RIB-BAK® trademark. For example, the U-channel post may be about 2 inches (about 51 millimeters) deep and about 3½ inches (about 89 millimeters) wide. The weight of the U-channel post may be about 5 pounds per foot (about 7.44 kilograms per meter). Although the post 30 may be shown as having a U-shaped cross-section, other configurations may be used as desired for a particular installation.

The support post 30 may be constructed of plain carbon steel having carbon content between about 0.4% and 1.0% by weight. Alternately, the plain carbon steel of the support post 30 may have carbon content in a range between about 0.69% and 0.75% by weight. The support post material may have yield strength between about 60,000 lbs/in$^2$ and about 100,000 lbs/in$^2$, and a tensile strength greater than about 80,000 lbs/in$^2$. Alternately, the support post 30 may have a yield strength greater than about 60,000 lbs/in$^2$ and a tensile strength greater than about 90,000 lbs/in$^2$. The yield strength may allow the support post 30 to provide sufficient support to resist the vehicle impact forces associated with an impact, and may then fracture to allow more energy to be absorbed.

The support post 30 may have a weight between about 2 and 7 pounds per foot of post length (between about 2.9 and 10.4 kilograms per meter). Alternatively, the weight of the support post 30 may be about 5 pounds per foot of post length (about 7.4 kilograms per meter). Prior steel support posts typically featured a weight of 8 pounds per foot of post length (about 11.9 kilograms per meter) or greater. Although these heavier support posts may be used, the support post 30 of the present disclosure may reduce the weight of the support posts and the accompanying cost of the posts.

By way of example, and not limitation, the support post 30 may be formed from U.S. new-billet steel, rail steel, or other types of steel alloys or other materials with the desired strength for the cable guardrail system 10. Further, the support post 30 may have a coating of polyester to provide durability and protection against rusting. Alternatively, the support post 30 may be hot-dip coated with zinc, aluminum, chromate, zinc-aluminum alloy or other coating to provide protection against the elements.

Installation of the support posts 30 may be completed using various techniques which are well known in the art. The particular technique used may depend upon the type of soil conditions and other factors associated with the roadway, and the type of road and other hazards involved in installation of the cable guardrail system 10. The support posts 30 may be installed with or without the use of metal foundation tubes or a concrete foundation.

While the invention has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalents thereof.

What is claimed is:

1. A roadway guardrail hanger system comprising:

a generally vertical roadway guardrail post, comprising a first end and a second end, wherein the second end is operatively coupled to the ground, and wherein the first end comprises a channel extending longitudinally along at least a portion of the guardrail post, and wherein the channel comprises at least a central web and opposed first and second flanges operatively coupled to the central web, and a top surface;

a roadway guardrail hanger formed from one or more sections of sheet metal, bar, or wire, with bends therein, said hanger comprising:

a first leg and a second leg, wherein said first and second legs are generally parallel to each other and wherein each comprises an upper end and an opposing lower end, and wherein each comprise an inner surface, a connecting portion integrally connecting the respective upper ends of said first and second legs, wherein said connecting portion, said first leg, and said second leg collectively define an interior space therebetween, first and second retaining seats, wherein said first and second retaining seats are disposed at said lower ends of said first and second legs, respectively, wherein said connecting portion hangs over said top surface of said channel, and said inner surfaces of said first and second legs frictionally engage opposing first and second sides of said central web, respectively, such that a respective one of said first and second legs is disposed within said channel;

one or more roadway guardrail cables, wherein said cables are disposed within said first and second retaining seats, respectively.

2. The system as claimed in claim 1, where the first retaining seat of the roadway guardrail hanger is positioned closer to the first end of the roadway guardrail post than the second retaining seat.

3. The system as claimed in claim 1, where each retaining seat of the roadway guardrail hanger at least partially encircles the one or more roadway guardrail cables.

4. The as claimed in claim 1, where the first retaining seat of the roadway guardrail hanger is laterally offset from the roadway guardrail post.

5. The as claimed in claim 1 further comprising one or more additional retaining seats on of the roadway guardrail hanger extending from one of the first and second legs of the hanger, the one or more additional retaining seats wrapped to support the one or more roadway guardrail cables.

6. The system as claimed in claim 1, wherein the roadway guardrail hanger is able to at least partially disengage from and move relative to the roadway guardrail post upon impact of a vehicle, with the one or more roadway guardrail cables being retained in the first or second seat, such that contact is maintained between the vehicle and the one or more roadway guardrail cables.

7. The system as claimed in claim 1, the inner surfaces of the first and second legs comprising a friction area providing resistance to the roadway guardrail post.

8. The system as claimed in claim 1, where at least one of the opposing legs of the roadway guardrail hanger is tapered toward the other leg.

9. A roadway guardrail hanger system comprising:

a plurality of generally vertical roadway guardrail posts, one or more of said plurality of posts comprising:

a first end and a second end, wherein the second end is operatively coupled to the ground, and wherein the first end comprises a channel extending longitudinally along at least a portion of the guardrail post, and wherein the channel comprises at least a central web and opposed first and second flanges operatively coupled to the central web, and a top surface;

a plurality of roadway guardrail hangers formed from one or more sections of sheet metal, bar, or wire, with bends therein, one or more of said plurality of hangers comprising:

a first leg and a second leg, wherein said first and second legs are generally parallel to each other and wherein each comprises an upper end and an opposing lower end, and wherein each comprise an inner surface, a connecting portion integrally connecting the respective upper ends of said first and second legs, wherein said connecting portion, said first leg, and said second leg collectively define an interior space therebetween, first and second retaining seats, wherein said first and second retaining seats are disposed at said lower ends of said first and second legs, respectively, wherein the connecting portion of each of said plurality of hangers hangs over a top surface of the channel of one of said plurality of posts, and said inner surfaces of said first and second legs frictionally engage opposing first and second sides of the central web of one of said plurality of posts, such that a respective one of said first and second legs of each hanger is disposed within said channel;

one or more roadway guardrail cables, wherein said cables are disposed within said first and second retaining seats, respectively.

10. The system as claimed in claim 9 further comprising:

a clip attached to each of the one or more roadway guardrail posts engaging the one or more roadway guardrail hangers; and wherein the clip assists to secure the roadway guardrail hangers to the roadway guardrail post and assists in preventing the roadway guardrail hanger from separating from the roadway guardrail post, while still allowing the roadway guardrail hanger to move relative to the roadway guardrail post.

11. The system as claimed in claim 9 further comprising: at least one hook-bolt affixed to at least a portion of one of the plurality of roadway guardrail posts and supporting at least one roadway guardrail cable.

12. The system as claimed in claim 9, wherein the first retaining seat is formed integrally with the second end of the first leg of each of the plurality of guardrail hangers and the second retaining seat is formed integrally with the second end of the second leg of each of the plurality of guardrail hangers.

13. The system as claimed in claim 9 the plurality of roadway guardrail posts comprising plain-carbon steel.

14. The system as claimed in claim 9, wherein each of the plurality of roadway guardrail posts comprises a U-channel cross-section that forms the channel.

15. The system as claimed in claim 9, where the first retaining seat of each guardrail hanger is positioned closer to the first end of the roadway guardrail post than the second retaining seat of each guardrail hanger.

16. The system as claimed in claim 9, where the first retaining seat of each of the roadway guardrail hangers is laterally offset from the roadway guardrail post.

17. The system as claimed in claim 9, wherein each of the plurality of roadway guardrail hangers further comprises one or more additional seats extending from one of the first and second legs of the hangers.

18. A roadway guardrail hanger system comprising:

a generally vertical roadway guardrail post, comprising a first end and a second end, wherein the second end is operatively coupled to the ground, and wherein the first end comprises a channel extending longitudinally along at least a portion of the guardrail post, and wherein the channel comprises at least a central web and opposed first and second flanges operatively coupled to the central web, and a top surface;

a roadway guardrail hanger formed from one or more sections of sheet metal, bar, or wire, with bends therein, said hanger comprising:

a first leg and a second leg, wherein said first and second legs are generally parallel to each other and wherein each comprises an upper end and an opposing lower end, and wherein each comprise an inner surface, a connecting portion integrally connecting the respective upper ends of said first and second legs, wherein said connecting portion, said first leg, and said second leg collectively define an interior space therebetween, first and second retaining seats, wherein said first and second retaining seats are disposed at said lower ends of said first and second legs, respectively, wherein said connecting portion hangs over said top surface of said channel, and said inner surfaces of said first and second legs frictionally engage opposing first and second sides of said central web, respectively, such that a respective one of said first and second legs is disposed within said channel;

one or more roadway guardrail cables, wherein said cables are disposed within said first and second retaining seats, respectively; and wherein the roadway guardrail hanger is able to at least partially disengage from and move relative to the roadway guardrail post upon impact of a vehicle, with the one or more roadway guardrail cables being retained in the first or second seat, such that contact is maintained between the vehicle and the one or more roadway guardrail cables.

* * * * *

UNITED STATES PATENT AND TRADEMARK OFFICE

CERTIFICATE OF CORRECTION

PATENT NO. : 8,246,013 B2
APPLICATION NO. : 12/367317
DATED : August 21, 2012
INVENTOR(S) : Frederick Mauer, Dallas James and Steven J. Conway It is certified that error appears in the above-identified patent and that said Letters Patent is hereby corrected as shown below:

Claim 4, Column 7, Line 35 and Claim 5, Column 7, Line 38. Please add --(system)-- after "The" in claims 4-5.

Signed and Sealed this
Twenty-seventh Day of November, 2012

David J. Kappos

David J. Kappos
*Director of the United States Patent and Trademark Office*